US006641125B2

(12) United States Patent
Bentley

(10) Patent No.: US 6,641,125 B2
(45) Date of Patent: Nov. 4, 2003

(54) VISE STOP

(76) Inventor: Donald R. Bentley, 511 E. King St., Meridian, ID (US) 83642

( * ) Notice: Subject to any disclaimer, the term of this patent is extended or adjusted under 35 U.S.C. 154(b) by 22 days.

(21) Appl. No.: 10/008,153

(22) Filed: Dec. 4, 2001

(65) Prior Publication Data

US 2003/0102615 A1 Jun. 5, 2003

(51) Int. Cl.[7] ..... B25B 1/24
(52) U.S. Cl. ..... 269/282; 269/304; 269/315
(58) Field of Search ..... 269/315–321, 269/305, 282, 283, 304; 411/534

(56) References Cited

U.S. PATENT DOCUMENTS

| | | | | |
|---|---|---|---|---|
| 3,575,434 A | | 4/1971 | Lemanski | |
| 3,827,686 A | * | 8/1974 | Storkh | 269/315 |
| 4,020,742 A | * | 5/1977 | Raymond | 269/71 |
| 4,030,718 A | | 6/1977 | Philipoff | |
| D265,378 S | | 7/1982 | Roby | |
| 4,909,691 A | * | 3/1990 | Bogel | 411/531 |
| 5,197,721 A | | 3/1993 | Ruberg | |
| 5,236,272 A | * | 8/1993 | Hibbard | 411/544 |
| 5,667,347 A | * | 9/1997 | Matthews | 411/534 |
| 5,735,513 A | * | 4/1998 | Toffolon | 269/138 |
| 5,895,184 A | | 4/1999 | Walters et al. | |
| 5,996,986 A | | 12/1999 | Ewing | |

* cited by examiner

*Primary Examiner*—Robert C. Watson
(74) *Attorney, Agent, or Firm*—Joseph W. Holland

(57) ABSTRACT

A vise stop for positioning a workpiece in a vise includes a crossbar having a first end, a second end and a mounting surface. The crossbar is attachable to the vise and a first stop arm is pivotally connected to the crossbar first end for positioning a workpiece along an X axis. In the preferred embodiment of the invention, a second stop arm is pivotally connected to the crossbar second end. A friction disc is compressively disposed between an inner face of both the first and second stop arms and the first and second ends of the crossbar. The friction disc allows the stop arm to be frictionally positionable and rotatable about its point of attachment to the crossbar end. The friction disc may be configured as a fiber washer, a spring washer or a compressible o-ring.

18 Claims, 5 Drawing Sheets

VISE STOP

BACKGROUND

1. Technical Field

The present invention relates to machine tools and more particularly to a vise stop configured to assure repeatability in the placement of a work piece in relationship to the machine tool.

2. Background of the Invention

Oftentimes in machining operations, it is necessary to perform repetitious machine tool functions on a plurality of substantially identical parts for mass producing a particular piece or part. Numerically or computer controlled milling machine tools, including mills and lathes, are highly adapted to this type of function. Nevertheless, each new work piece must be set up with particular care to assure that reference surfaces are positioned substantially identically, that is, positioned in the same X, Y & Z axes so as to assure repeatability of the machining operation and quality of the final product.

In most machining environments today, a Y axis may be fixed by setting the jaws of a machine tool vise in a specific location and then setting the vice so that the fixed jaw becomes a reference point on the Y axis. Similarly, the seat of the vice, once the vice is installed and bolted to the table of the machine tool, establishes a repeatable reference for the Z axis. Location then of the work piece on the Y axis and repeatability of this location has remained challenging.

A number of solutions have been proposed with limitations. In some instances, devices lack rigidity and may loose their ability to produce accurate positioning of piece after piece in relationship to the cutting tool. This is particularly the case where the device or stop is multi-jointed and includes excessive joints and degrees of movement or rotation. Other problems may arise where the vise stop effectively limits access of the machine tool or the cutting tool to various surfaces of the work piece. In some instances, the configuration of the vise stop limits the ability of the cutting tool to access only the top surface of the work piece.

What is needed is a simple and effective vise stop which allows repeatability of placement of parts, particularly along the X axis, in relationship to the cutting tool and which allows the work piece to be machined on all surfaces and faces which would otherwise be exposed to the cutting tool. Additionally, the device for locating the work piece should also include the ability to position the stop in relationship to both the vice and the work piece so that it may be moved out of the way when necessary or kept in position as required.

SUMMARY OF THE INVENTION

The present invention is directed to a vise stop for positioning a workpiece in a vise, the vise stop including a crossbar having a first end, a second end and a mounting surface. The crossbar is configured for attachment to the vise and a first stop arm is pivotally connected to the crossbar first end for positioning a workpiece along an X axis. In the preferred embodiment of the invention, a second stop arm is pivotally connected to the crossbar second end.

In the preferred embodiment of the invention, a friction disc is compressively disposed between an inner face of both the first and second stop arms and the first and second ends of the crossbar. The friction disc allows the stop arm to be frictionally positionable and rotatable about its point of attachment to the crossbar end. The friction disc may be configured as a fiber washer, a spring washer or a compressible o-ring. This feature of the invention allows an operator the freedom of angularly positioning and repositioning the first and second stop arms as required without loosening the carriage bolt or other means for attaching the first and second stop arms to the crossbar.

In the preferred embodiment of the invention, the stop arms each include an adjustable stop tip. A first adjustable stop tip threadedly engages a distal end of the first stop arm, the first adjustable stop tip extending from the distal end of the first stop arm at an angle lying substantially perpendicular to a longitudinal axis of the first stop arm. Similarly, a second stop tip threadedly engages a distal end of the second stop arm, the second adjustable stop tip extending from the distal end of the second stop arm at an angle lying substantially perpendicular to a longitudinal axis of the first stop arm. Both the first and second adjustable stop tips may be locked in position by a locknut.

Other advantages will become apparent to those skilled in the art from the following detailed description read in conjunction with the appended claims attached hereto.

DETAILED DESCRIPTION OF THE INVENTION

Figure 1:
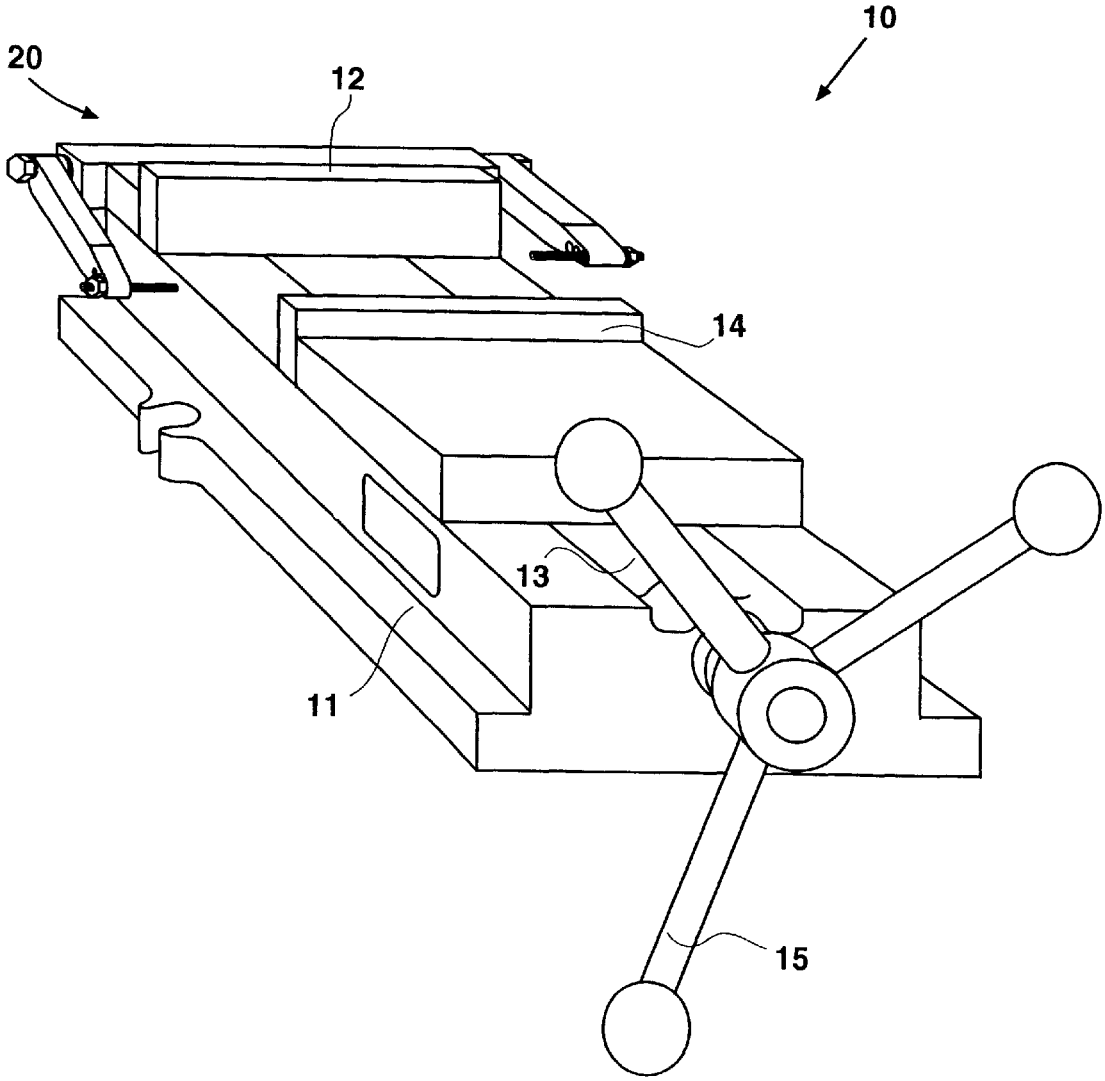
FIG. 1 is a perspective representational view of a machinist's vise including a vise stop according to the present invention.

Referring to FIG. 1, vise 10 is shown including vise stop 20. Vise 10 includes vise body 11. Fixed jaw 12 extends generally upward from body 11 and opposes movable jaw 14. Carriage screw 13 is rotatably secured to body 11 and movable jaw 14 is threadedly engaged along the length of carriage screw 13. Rotatable handle 15 provides a means for advancing movable jaw 14 along the length of carriage screw 13. Vise stop 20 is shown attached to fixed jaw 12.

Figure 2:
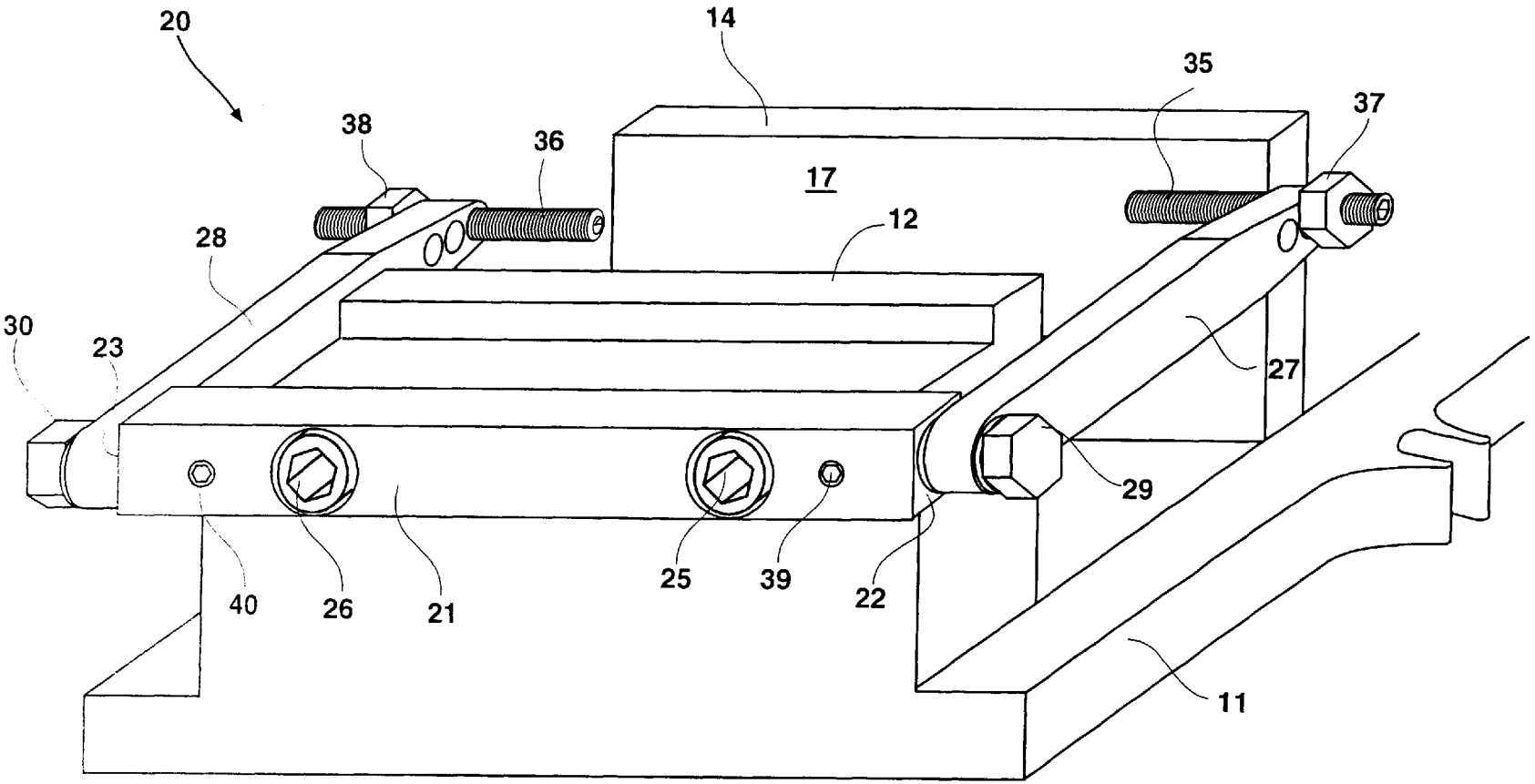
FIG. 2 is a perspective representational detail view of a machinist's vise including a vise stop according to the present invention.

Referring to FIG. 2, vise stop 20 is shown attached to fixed jaw 12 of vise 10 by first crossbar attachment screw 25 and second crossbar attachment screw 26. As shown, vise 10 includes vise body 11 from which fixed jaw 12 extends generally upward. Fixed jaw 12 is shown opposing movable jaw 14. FIG. 2 shows first stop arm 27 rotatably attached at crossbar first end 22 by first stop arm attachment screw 29. Similarly, second stop arm 28 is shown rotatably attached at crossbar second end 23 by second stop arm attachment screw 30.

First stop arm 27 includes first adjustable stop tip 35. First lock nut 37 provides a means for securing first adjustable stop tip 35 at a pre-selected length of adjustment. Similarly, second stop arm 28 includes second adjustable stop tip 36. Second lock nut 38 provides a means for securing second adjustable stop tip 36 at a pre-selected length of adjustment.

Figure 3:
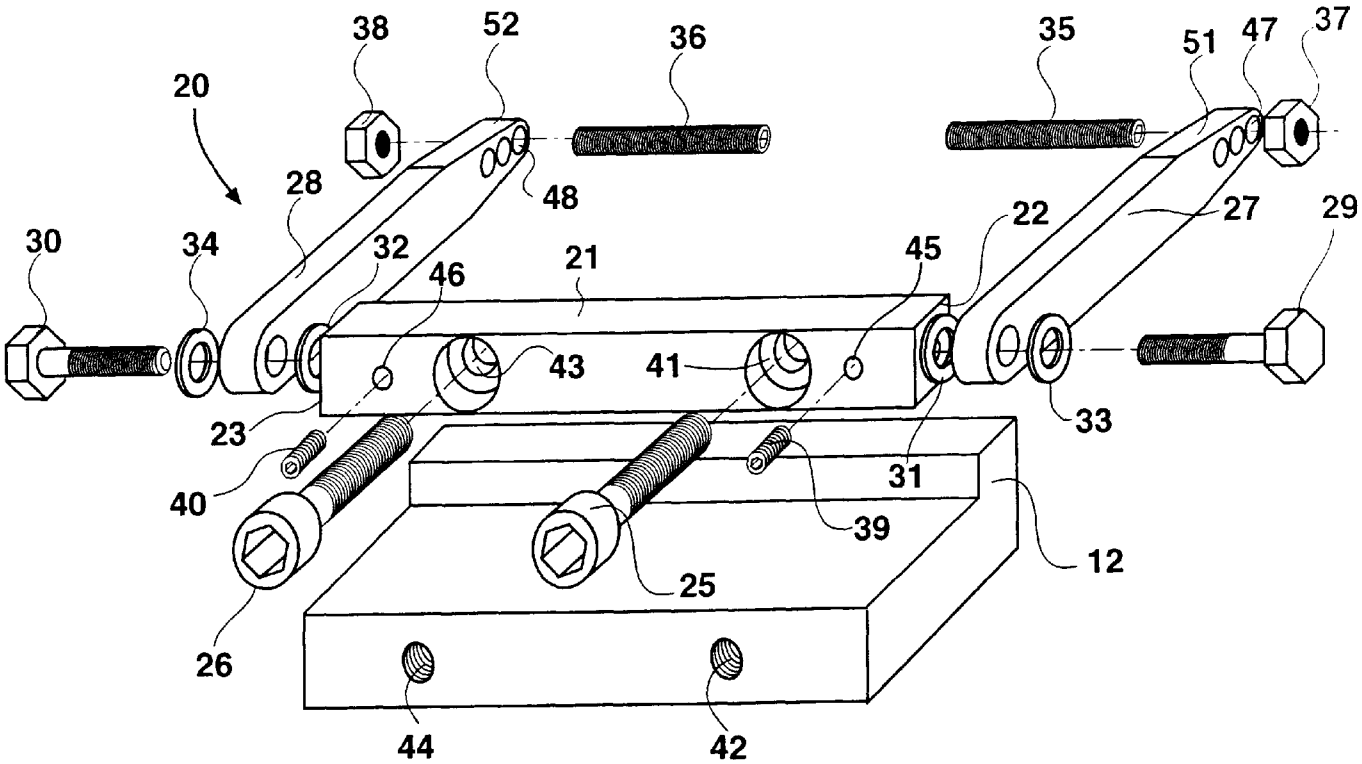
FIG. 3 is an exploded perspective representational detail view of a machinist's vise including a vise stop according to the present invention.

FIG. 3 is an exploded perspective view of vise stop 20. Fixed jaw 12 is shown for reference. Vise stop 20 includes crossbar 21 which is attachable to fixed jaw 12 by first crossbar attachment screw 25 and second crossbar attachment screw 26. First crossbar attachment screw 25 projects through first crossbar screw aperture 41 for threaded engagement with first fixed jaw threaded engagement aperture 42. Similarly, second crossbar attachment screw 26 projects through second crossbar screw aperture 43 for threaded engagement with second fixed jaw threaded engagement aperture 44.

Crossbar 21 includes crossbar first end 22 and crossbar second end 23. First stop arm 27 is rotatably attached at crossbar first end 22 by first stop arm attachment screw 29 and second stop arm 28 is rotatably attached at crossbar second end 23 by second stop arm attachment screw 30. First friction disc 31 is disposed between crossbar first end 22 and an inner face of first stop arm 27. First stop arm flat washer 33 is disposed between an outer face of first stop arm 27 and a head of first stop arm attachment screw 29 providing a bearing surface at such interface. When first stop arm attachment screw 29 is torqued to a pre-selected value, first stop arm 27 is frictionally positionable, as first friction disc 31 provides first and second bearing surfaces against which crossbar first end 22 and an inner face of first stop arm 27 may be rotationally offset against one another about first stop arm attachment screw 29.

Similarly, second friction disc 32 is disposed between crossbar second end 23 and an inner face of second stop arm 28. Second stop arm flat washer 34 is disposed between an outer face of second stop arm 28 and a head of second stop arm attachment screw 30 providing a bearing surface at such interface. When second stop arm attachment screw 30 is torqued to a pre-selected value, second stop arm 28 is frictionally positionable, as second friction disc 32 provides first and second bearing surfaces against which crossbar second end 23 and an inner face of second stop arm 28 may be rotationally offset against one another about second stop arm attachment screw 30. In either case, the pre-selected torque value for first stop arm attachment screw 29 and second stop arm attachment screw 30 should be in the range of 2–50 ft/lb. and more preferably in the range of 5–25 ft/lb., and in those instances wherein stop arm attachment screw 29 and second stop arm attachment screw 30 have a nominal diameter substantially equal to 0.375", the torque value should be in the range of 10–20 ft/lb.

First adjustable stop tip 35 is shown positioned for engagement through distal end 51 of first stop arm 27 through first stop tip threaded aperture 47. First lock nut 37 is threadedly engageable with first adjustable stop tip 35 and provides a means for securing first adjustable stop tip 35 so that a pre-selected length of first adjustable stop tip 35 projects through distal end 51 of first stop arm 27 for indexing against a workpiece.

Similarly, second adjustable stop tip 36 is shown projecting through distal end 52 of second stop arm 28 through second stop tip threaded aperture 48. Second lock nut 38 threadedly engages second adjustable stop tip 36 and provides a means for securing second adjustable stop tip 36 so that a pre-selected length of second adjustable stop tip 36 projects through distal end 52 of second stop arm 28 for indexing against a workpiece.

First stop arm set screw 39 projects through first set screw aperture 45 for engagement against a threaded outer diameter of first stop arm attachment screw 29 to prevent first stop arm attachment screw 29 from backing out inadvertently. Similarly, second stop arm set screw 40 projects through second set screw aperture 46 for engagement against a threaded outer diameter of second stop arm attachment screw 30 to prevent second stop arm attachment screw 30 from backing out inadvertently. First stop arm set screw 39 and second stop arm set screw 40 are preferably formed of a polymeric material such that the tip will compressively conform against the threaded outer diameter of first stop arm attachment screw 29 or second stop arm attachment screw 30 without causing damage to such threaded components.

Figure 4:
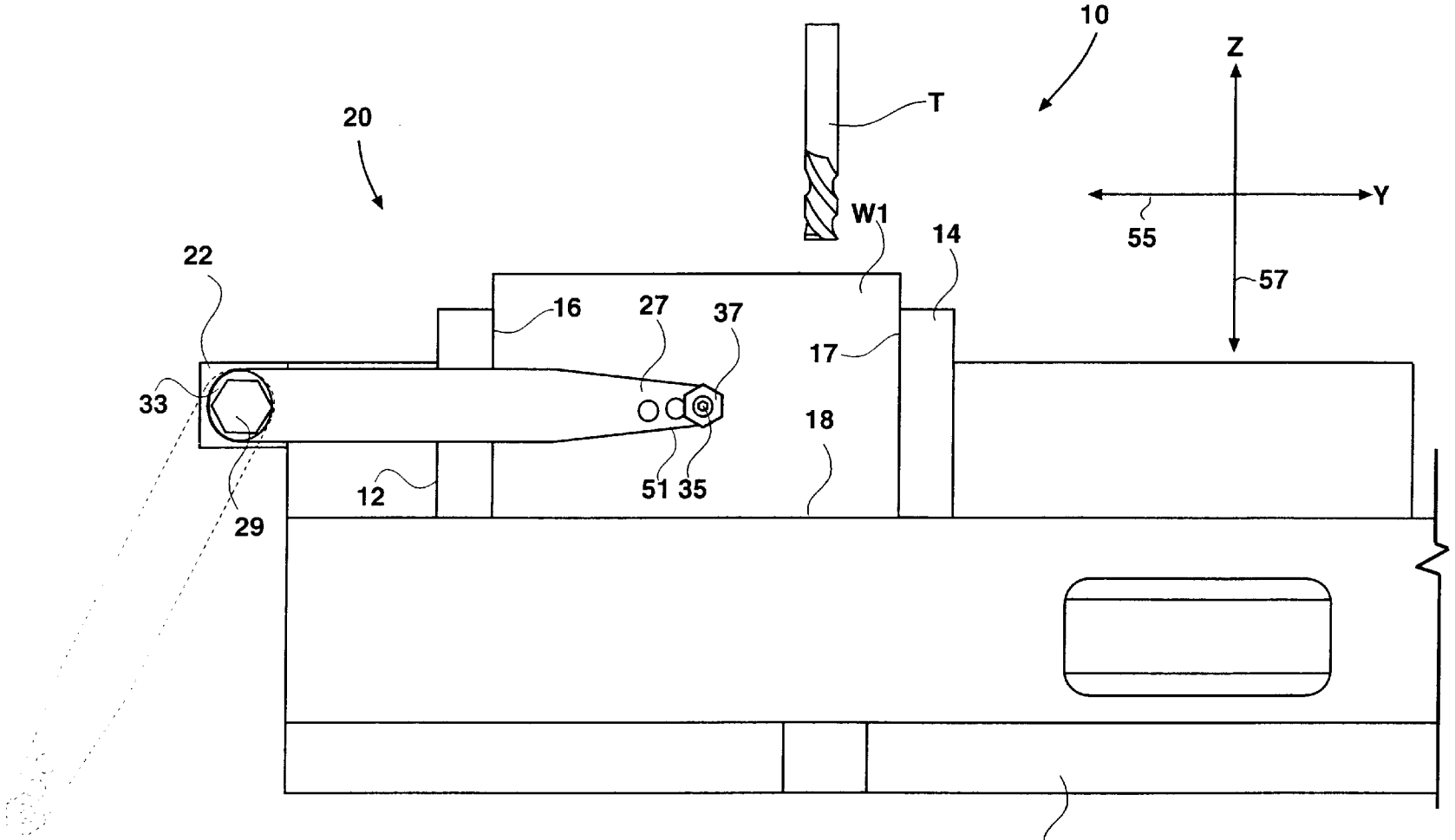
FIG. 4 is a side representational view of a machinist's vise including a vise stop according to the present invention.
Figure 5:
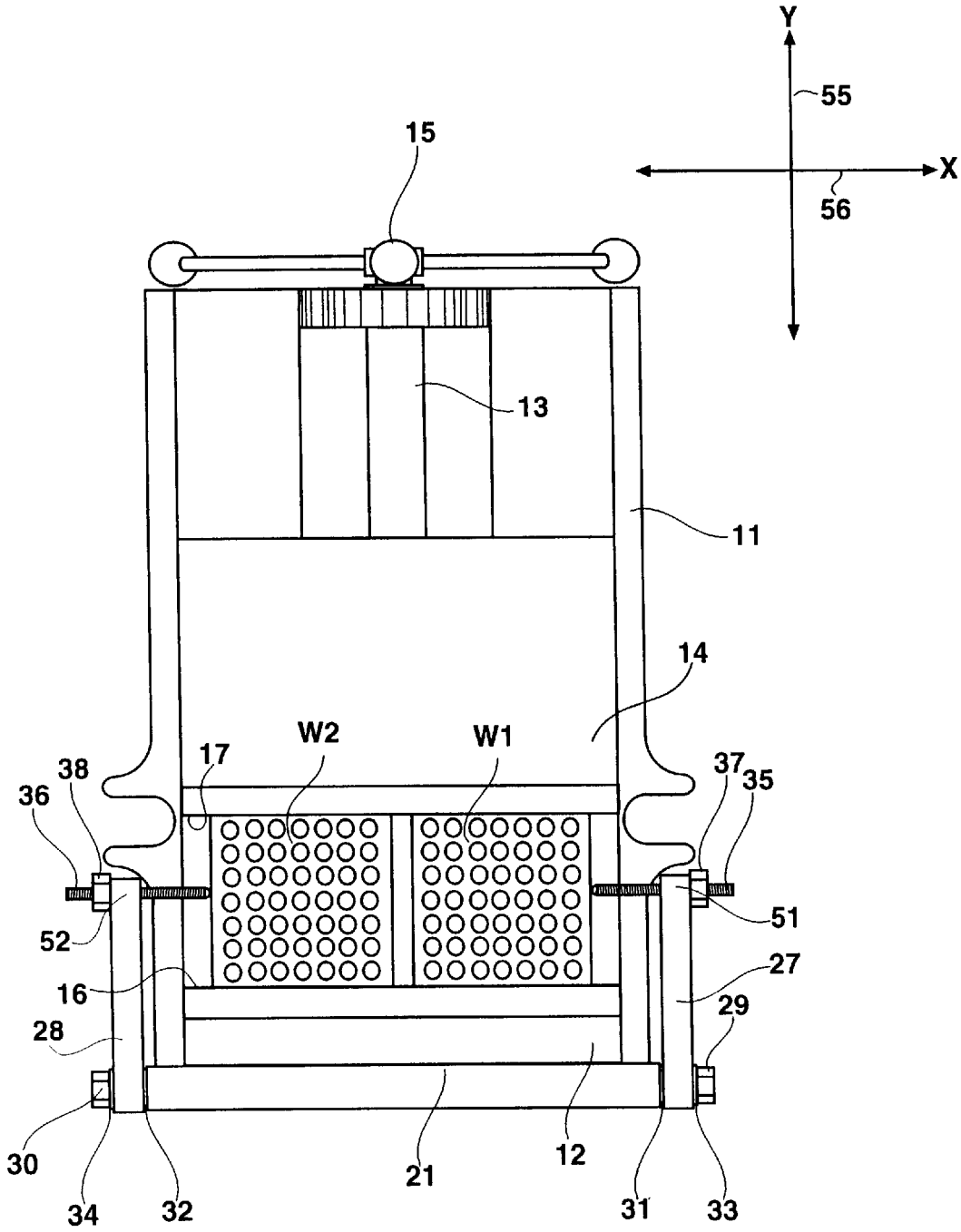
FIG. 5 is a top representational view of a machinist's vise including a vise stop according to the present invention.

Referring to FIGS. 4 and 5, vise 10 is shown including vise stop 20. Vise 10 includes vise body 11. Fixed jaw 12 extends generally upward from body 11 and opposes movable jaw 14. Vise stop 20 is shown attached to fixed jaw 12. Workpiece W1 is compressively held between fixed jaw 12 and opposing movable jaw 14. Referring to FIG. 5, carriage screw 13 is rotatably secured to body 11 and movable jaw 14 is threadedly engaged along the length of carriage screw 13. Rotatable handle 15 provides a means for advancing movable jaw 14 along the length of carriage screw 13.

FIG. 4 shows first stop arm 27 rotatably attached at crossbar first end 22 by first stop arm attachment screw 29. First stop arm 27 includes first adjustable stop tip 35, shown in FIG. 3. First lock nut 37 provides a means for securing first adjustable stop tip 35 at a pre-selected length of adjustment. Machine tool T is shown positioned above workpiece W1.

Referring to FIG. 5, crossbar 21 includes crossbar first end 22 and crossbar second end 23. First stop arm 27 is rotatably attached at crossbar first end 22 by first stop arm attachment screw 29 and second stop arm 28 is rotatably attached at crossbar second end 23 by second stop arm attachment screw 30. First friction disc 31 is shown disposed between crossbar first end 22 and an inner face of first stop arm 27. First stop arm flat washer 33 is disposed between an outer face of first stop arm 27 and a head of first stop arm attachment screw 29 providing a bearing surface at such interface. Similarly, second friction disc 32 is disposed between crossbar second end 23 and an inner face of second stop arm 28. Second stop arm flat washer 34 is disposed between an outer face of second stop arm 28 and a head of second stop arm attachment screw 30 providing a bearing surface at such interface. First stop arm 27 includes first adjustable stop tip 35. First lock nut 37 provides a means for securing first adjustable stop tip 35 at a pre-selected length of adjustment. Similarly, second stop arm 28 includes second adjustable stop tip 36. Second lock nut 38 provides a means for securing second adjustable stop tip 36 at a pre-selected length of adjustment.

Referring to FIG. 4, workpiece W1 is repeatably locatable along Y axis 55 by placement of workpiece W1 between fixed jaw face 16 which provides a Y axis reference surface and movable jaw face 17. Similarly, workpiece W1 is repeatably locatable along Z axis 57 by placement of workpiece W1 against upper surface 18 of vise body 11 which provides a Z axis reference surface.

FIG. 5 shows workpiece W1 and workpiece W2 compressively held between fixed jaw 12 and opposing movable jaw 14. Workpiece W1 is repeatably locatable along X axis 56 by positioning workpiece W1 against first adjustable stop tip 35. Similarly, workpiece W2 is repeatably locatable along X axis 56 by positioning workpiece W2 against second adjustable stop tip 36.

While this invention has been described with reference to the described embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

I claim:

1. A vise stop for positioning a workpiece in a vise comprising:

a crossbar including a first end, a second end and a mounting surface, the crossbar attachable to a vise;

a second stop arm pivotally connected to and frictionally positionable in relationship to the crossbar second end; and a first stop arm pivotally connected to and frictionally positionable in relationship to the crossbar first end.

2. The vise stop of claim 1 further comprising a friction disc compressively disposed between the first stop arm and the crossbar first end.

3. The vise stop of claim 1 further comprising a friction disc compressively disposed between the second stop arm and the crossbar second end.

4. The vise stop of claim 1 further comprising a first adjustable stop tip threadedly engaging a distal end of the first stop arm, the first adjustable stop tip extending from the distal end of the first stop arm at an angle lying substantially perpendicular to a longitudinal axis of the first stop arm.

5. The vise stop of claim 1 further comprising a second adjustable stop tip threadedly engaging a distal end of the second stop arm, the second adjustable stop tip extending from the distal end of the second stop arm at an angle lying substantially perpendicular to a longitudinal axis of the second stop arm.

6. The vise stop of claim 4 further comprising a locking first adjustable stop tip threadedly engaging a distal end of the first stop arm, the locking first adjustable stop tip extending from the distal end of the first stop arm at an angle lying substantially perpendicular to a longitudinal axis of the first stop arm.

7. The vise stop of claim 5 further comprising a locking second adjustable stop tip threadedly engaging a distal end of the second stop arm, the second adjustable stop tip extending from the distal end of the second stop arm at an angle lying substantially perpendicular to a longitudinal axis of the second stop arm.

8. The vise stop of claim 2 wherein the friction disc further comprises a fiber washer.

9. The vise stop of claim 3 wherein the friction disc further comprises a fiber washer.

10. The vise stop of claim 2 wherein the friction disc further comprises a spring washer.

11. The vise stop of claim 3 wherein the friction disc further comprises a spring washer.

12. The vise stop of claim 2 wherein the friction disc further comprises a compressible o-ring.

13. The vise stop of claim 3 wherein the friction disc further comprises a compressible o-ring.

14. A vise for compressively holding a workpiece in relationship to a machine tool comprising:

a vise body including a fixed jaw;

a carriage screw threadedly engaging the vise body;

a movable jaw threadedly engaging the carriage screw and opposingly advanceable along the carriage screw; and a vise stop for positioning a part in a vise comprising a crossbar including a first end, a second end and a mounting surface, the crossbar attachable to a vise and a first stop arm pivotally connected to and frictionally positionable in relationship to the crossbar first end and a second stop arm pivotally connected and frictionally positionable in relationship to the crossbar second end.

15. The vise stop of claim 14 further comprising a friction disc compressively disposed between the first stop arm and the crossbar first end.

16. The vise stop of claim 15 further comprising a friction disc compressively disposed between the second stop arm and the crossbar second end.

17. The vise stop of claim 14 further comprising a first adjustable stop tip threadedly engaging a distal end of the first stop arm, the first adjustable stop tip extending from the distal end of the first stop arm at an angle lying substantially perpendicular to a longitudinal axis of the first stop arm.

18. The vise stop of claim 15 further comprising a second adjustable stop tip threadedly engaging a distal end of the second stop arm, the second adjustable stop tip extending from the distal end of the second stop arm at an angle lying substantially perpendicular to a longitudinal axis of the second stop arm.

* * * * *